US005509238A

United States Patent [19]

Scalfati

[11] Patent Number: 5,509,238

[45] Date of Patent: Apr. 23, 1996

[54] MULTIDIRECTIONAL MECHANICAL DEVICE DISSIPATING ENERGY, PARTICULARLY FOR THE CONSTRAINT OF STRUCTURES IN SEISMIC ZONES

[75] Inventor: Daniele Scalfati, Viale Gorgia di Leontini, Italy

[73] Assignee: TIS Techniche Idraulico Stradali S.p.A., Rome, Italy

[21] Appl. No.: 283,983

[22] Filed: Aug. 1, 1994

[30] Foreign Application Priority Data

Aug. 3, 1993 [IT] Italy ..... RM93A0530

[51] Int. Cl.[6] ..... E04H 9/02

[52] U.S. Cl. ..... 52/167.7; 52/167.4

[58] Field of Search ..... 52/167.4, 167.7

[56] References Cited

FOREIGN PATENT DOCUMENTS 2901134 1/1992 WIPO ..... 52/167.7

*Primary Examiner*—Carl D. Friedman

*Assistant Examiner*—Yvonne Horton-Richardson

*Attorney, Agent, or Firm*—Brumbaugh, Graves, Donohue & Raymond

[57] ABSTRACT

A multidirectional mechanical device for dissipating energy, particularly for the constraint of structures in seismic zones, includes a plurality of C-shaped elastic-plastic response elements provided between two parallel planes. Each element is attached at one end by a fixed joint and at the other end by a cylindrical hinge having an axis perpendicular to the plane upon which the forces act so as to allow a portion of the element adjacent to the second end to rotate around the cylindrical hinge when the forces cause the element to become skewed.

6 Claims, 2 Drawing Sheets

MULTIDIRECTIONAL MECHANICAL DEVICE DISSIPATING ENERGY, PARTICULARLY FOR THE CONSTRAINT OF STRUCTURES IN SEISMIC ZONES

BACKGROUND OF THE INVENTION

The present invention concerns a multidirectional mechanical device dissipating energy, particularly for the constraint of structures in seismic zones.

More particularly, the invention is referred to civil engineer structures in general, constructed in zones interested by seismic phenomenon. The solution according to the invention realizes a constraint element having the aim of dispersing the energy transmitted by the earthquake to the structure, so that the collapse of the same is avoided, greatly reducing, if not even eliminating breaking or other kinds of damages.

It is in fact well known that earthquake constitutes a release of energy stored in the underground. This energy, that reveals as shakings, is transferred to the structure and continues to shake it until it is completely dissipated. Such a dissipation, in the conventional strategy, occurs to the detriment of inner sliding in the structure.

When the structure is enough strong, said slidings are limited within little values and this does not involve a damage.

Thus, it is understood that in order to have the certainty against damages it is necessary to provide either structures extremely strong (and thus not acceptable under the economical point of view), or devices upon which the energy dissipation can be concentrated, able to control the stress transferred to the structure in such a way to avoid that it is damaged.

Otherwise, when during the time the structure gives less resistance to the earthquake action, great strains are present and consequently breaking and thus partial or total collapses.

In the field of the dissipating devices having an elastic-plastic behaviour, based on a mechanical action and a multidirectional response (i.e. a response not depending on the action direction of the external stress), the present technology, studied to reduce the structural engagement during the earthquake, basically uses elements having dimensions subjected to the ratio between the "maximum strength requested" and the "maximum corresponding movement". This choice involves big dimensions and high costs of the devices.

Among the solutions known in this field, many monodirectional solutions have been suggested.

A first solution is described in the Italian patent application N° 2022A/87, concerning a "Mechanical energy and charge limiting and dissipating device, for the connection of structural elements, particularly suitable for the seismic protection of bridges, viaducts, buildings and like."

The main drawback of this kind of solution resides in the fact that it is monodirectional, so that it does not allow a dissipation on different planes, unless very complicated and bulky solutions are used.

In the Italian patent application N° 47866-A/88 it is described a "Track-like mechanical device for dissipating energy" providing a solution structurally similar to the one described in the previous document, wherein the track provides inside a shape element obliging the same track to maintain the original shape when stressed.

In this case too the main drawback is due to the fact that the device is monodirectional.

Another solution is the one described in the Italian patent application N° 20856-A/90, concerning a "Damper device for the seismic protection of structures like viaducts and similar."

It concerns a multidirectional device providing two C-shaped elements, having a square or round cross-section and a double symmetry.

The main drawback of this solution is due to the fact that has a very low energy absorption.

A last solution known to the Applicant is the one described in the Italian patent application N° MI91A000013, describing a "Constraint device for viaducts and like.

In this solution there are noticeable constraints, since it is provided the superimposition of a plurality of plates. In order to obtain this, constraints due to the cold bending of the plates, and to the need of reducing the stretching of the same, are present, so that high thickness are necessary.

Furthermore, it is a monodirectional device.

SUMMARY OF THE INVENTION

The present finding uses a consolidated dissipative technology, i.e. the technology concerning the use of the sliding imposed on the ends of a metallic C-shaped band, up to now used basically to realize monodirectional devices and particularly for sliding along the C plane realized by the band axis line.

The finding allows to use the same technology also for movements out of said plane, making it suitable to work in any direction of the stress. On the contrary, taking into consideration the absolutely random nature of the direction of the motion during an earthquake, the C-shaped elements always work in a different stress condition with respect to the one for which they have been used until now, contemporaneously combining flexion and torsion and re-establishing the linkage in the sizing of the same elements, between strength and plastic motion.

This new functional aspect confers to the C-shaped new and original features able to differentiate the same with respect to the same used with a guided monodirectional response.

In fact, the technology employing a bent band allows to separately consider the force supported with respect to the permitted movement, but only when the deformation occurs, as already said, along the C axis plane.

For movement directions of the ends out of the above mentioned plane, and in any case lying on a plane normal with respect to the same, the response instead varies in function of the direction of the movement.

It is therefore a specific object of the present invention a multidirectional mechanical device dissipating energy, particularly for the constraint of structures in seismic zones, able to give a dissipative response for forces acting on a plane, for any direction of the same forces, comprising at least one elastic-plastic response element, provided between two parallel planes, realizing the connection with structure or making the same structure, said at least one element being constrained at a first end by a restrained joint, and at the other end by a cylindrical hinge having an axis perpendicular to the plane upon which the force acts.

Preferably, according to the invention, a plurality of elastic-plastic response elements can be provided, said elements being arranged according to any disposition avoiding that they interfere each other.

Still according to the invention, said at least one dissipative element can be made up of a C-shaped plate having the undeformed axis line perpendicular to the action plane of the forces.

Further according to the invention, every elastic-plastic response element can be made up of a plurality of single elements disposed side-by-side.

Always according to the invention, the single element can be realized also superimposing more than one plate, preferably having a different thickness.

Still according to the invention, said dissipating elements can be arranged in such a way to give differentiated responses, i.e. approximating a constant value, according to the preferred action directions of the forces along the plane.

The arrangement of the dissipating elements can be such to allow the introduction of a bearing apparatus in the same device, said apparatus being able to support the loads orthogonal with respect to the elastic-plastic response plane.

BRIEF DESCRIPTION OF THE DRAWINGS

The present invention will be now described in an illustrative, but not limitative way, according to its preferred embodiments, with particular reference to the figures of the enclosed drawings, wherein.

DETAILED DESCRIPTION

Figure 1:
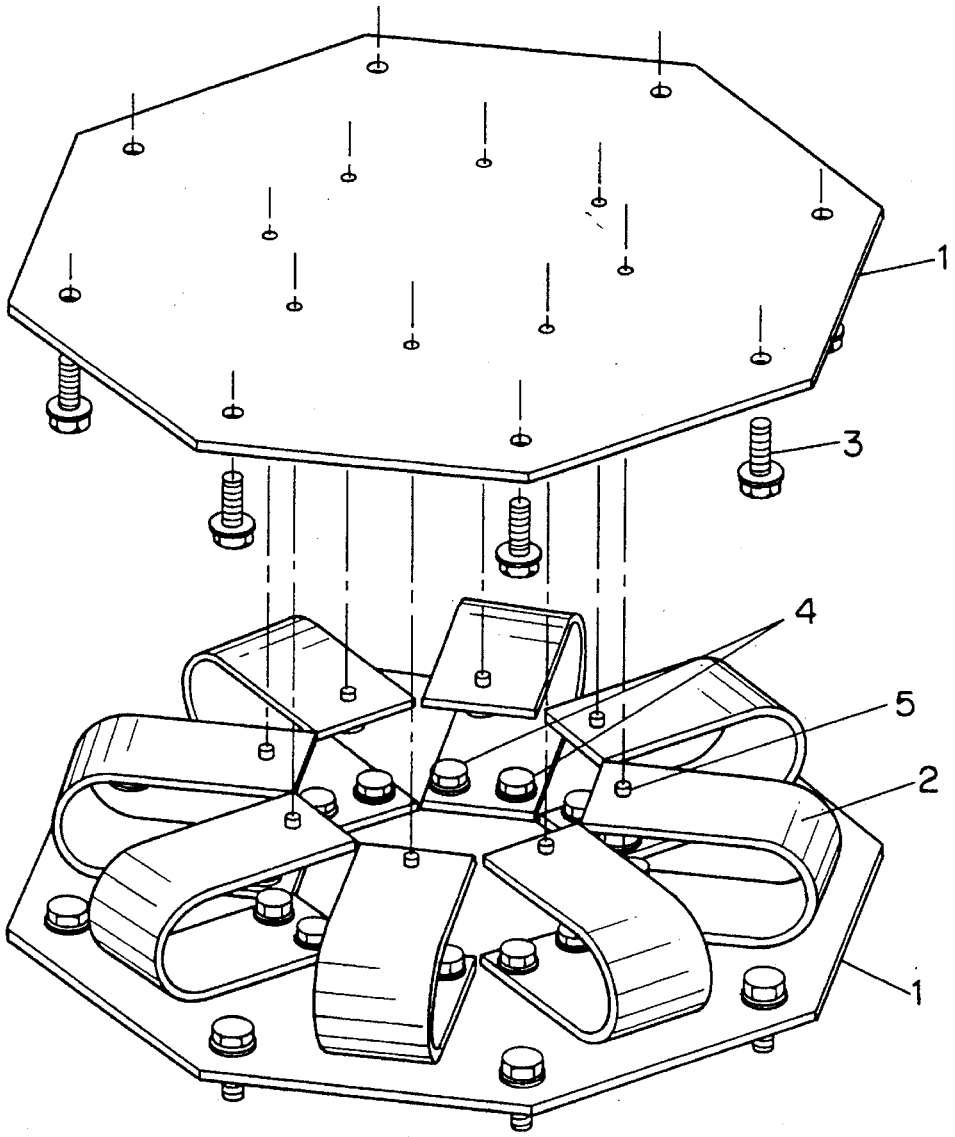
FIG. 1 is an exploded perspective view of a first embodiment of the device according to the invention.
Figure 2:
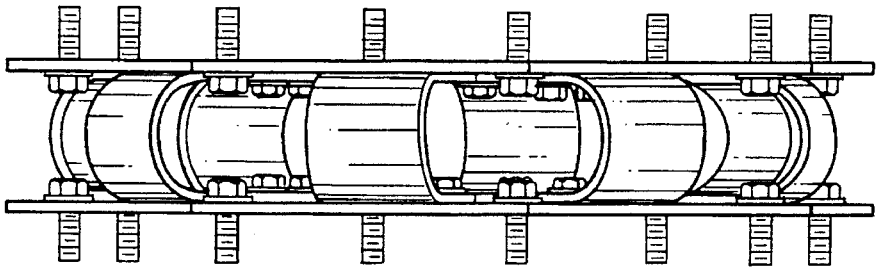
FIG. 2 is a lateral view of the device of FIG. 1.

Particularly, the finding, in the embodiment shown in the FIGS. 1 and 2, comprises two external dragging and guiding plates 1 for the deformation of the dissipative band C-shaped elements 2; their function is furthermore that of connection with the structure by the log bolts 3, by which the transfer of the load between the structure and the dissipative elements occurs.

The number of C-shaped elements is due to the design needing. They can be simple or made up by the superimposition of a plurality of plates, conveniently having an outwardly growing thickness (considering inner the center of the bent sector); it is well known that the force absorbed by said elements is proportional to the radius of curvature, while the allowed movement only depends on the length of the straight arms; this is true, even if the mechanical working criteria has different aspects, both for the elements stressed along the plane of the undeformed C, and for those stressed perpendicularly with respect to the same plane, and consequently also for those having a stress inclined in any direction.

In order to allow a proper working of the elements 2, with a stress on the ends according to any direction, it is also necessary, as noted in many tests made by the Applicant, that the constraint of the ends of the C-shaped elements 2 is realized in such a way to allow the deformations required without starting unstability phenomenon of the mechanism; the main feature of the finding being in fact the restrained joint on one end, e.g. by two connections 4, or by welding, or by any other system preventing the movements and the rotations, and a cylindrical hinge constraint on the other end, e.g. by a connection as the one shown by the reference 5.

With this kind of solution, and for a suitable distribution of the elements 2, the "total" response of the device, sum of the contribution of the single C-shaped elements 2 in the different deformed configurations, can be considered constant whichever is the direction of the seismic action.

In case differentiated responses according two or more directions are desired, a disposition and an orientation of the C-shaped elements concentrated can be supposed.

Figure 3:
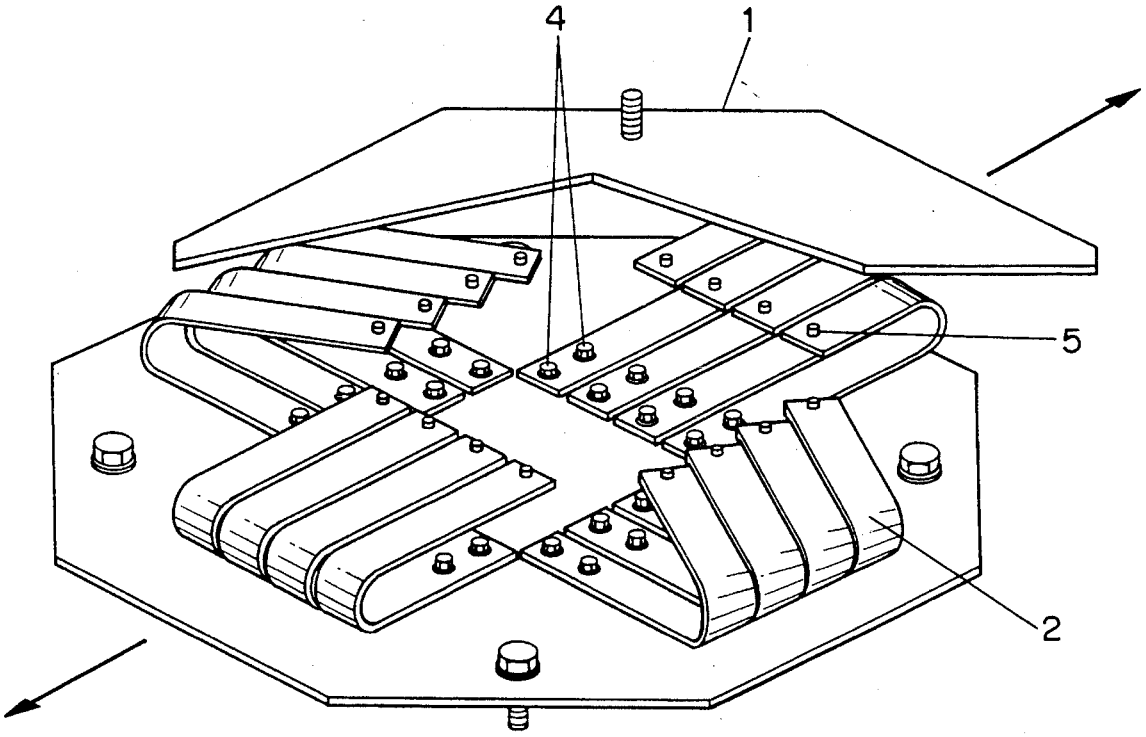
FIG. 3 is an exploded perspective view of a second embodiment of the element according to the invention.

This kind of solution is shown in FIG. 3, showing a conditioned response device, according two perpendicular preferred directions. For reasons of clarity, the upper plate 1 is sectioned and the device is shown deformed under the action of the stress represented by the arrow.

The single C-shaped elements 2, in both the solutions, can be simple bands, or they can be realized by the superimposition of a plurality of bands, suitably having a growing thickness, in order to realize a C-shaped package.

The solution allowing the use of these elements as multidirectional elements is that of constraining one end by a restrained joint and the other end by a cylindrical hinge constraint, with an axis perpendicular to the action plane of the stress.

It is to be understood that the plane upon which the stresses act is always perpendicular to those individuated by the axis lines of the C-shaped elements 2 undeformed.

Providing a suitable distribution of the dissipative elements, so as to leave a central space to this end, it is possible to introduce a bearing device.

It confers to the whole device at the same time horizontal dissipative constraint features, consequently optimizing the dimensions of the system.

The present invention has been described in an illustrative, but not limitative, way according to its preferred embodiments, but it is to be understood that modifications and/or changes can be introduced by those skilled in the art without departing from the scope as defined by the enclosed claims.

I claim:

1. A multidirectional mechanical device for dissipating energy, particularly for the constraint of structures in seismic zones, able to give a dissipative response for forces acting on a plane, for any direction of the same forces, characterized in that it comprises a plurality of C-shaped elastic-plastic response elements, provided between two parallel planes, each element being constrained at a first end by a restrained joint, and at a second end by a cylindrical hinge having an axis perpendicular to the plane upon which said forces act so as to allow a portion of the element adjacent to the second end to rotate around the cylindrical hinge when said forces act.

2. A multidirectional mechanical device for dissipating energy according to claim 1, characterized in that each of said elements is made up of a plurality of single elements disposed side-by-side.

3. A multidirectional mechanical device for dissipating energy according to claim 1, characterized in that each of said elements is composed of more than one plate.

4. A multidirectional mechanical device for dissipating energy according to claim 3, characterized in that each of the plates of each element has a different thickness.

5. A multidirectional mechanical device for dissipating energy according to claim 4, characterized in that said elements are arranged in such a way as to give differentiated responses approximating a constant value, according to directions in which the forces act along the plane.

6. A multidirectional mechanical device for dissipating energy according to claim 1, characterized in that the arrangement of the elements is such as to allow the introduction of a bearing apparatus in the same device, said apparatus being able to support the loads orthogonal with respect to the elastic-plastic response plane.

* * * * *

UNITED STATES PATENT AND TRADEMARK OFFICE

CERTIFICATE OF CORRECTION

PATENT NO. : 5,509,238

DATED : April 23, 1996

INVENTOR(S) : Daniele Scalfati

It is certified that error appears in the above-indentified patent and that said Letters Patent is hereby corrected as shown below: On the title page:

Item 75, "Viale Gorgia di Leontini" should read --Rome--;

Item [56]

1st Column, last line, "2901134" should read --9201134--;

Column 1, line 53, "2022A/87" should read --12022A/87--.

Signed and Sealed this

Fifteenth Day of October, 1996

Attest:

BRUCE LEHMAN

Attesting Officer

Commissioner of Patents and Trademarks